United States Patent [19]

Simons

[11] Patent Number: 4,754,735

[45] Date of Patent: Jul. 5, 1988

[54] CONTROL OF FUEL INJECTION APPARATUS FOR INTERNAL COMBUSTION ENGINES

[76] Inventor: Peter W. Simons, 2 Bolton Street, E. Fremantle, West Australia, Australia

[21] Appl. No.: 70,119

[22] Filed: Jul. 6, 1987

Related U.S. Application Data

[63] Continuation of Ser. No. 894,459, Aug. 5, 1986, abandoned, which is a continuation of Ser. No. 751,455, Jul. 2, 1985, abandoned, which is a continuation of Ser. No. 626,718, Jul. 2, 1984, abandoned, which is a continuation-in-part of Ser. No. 454,656, Dec. 30, 1982, abandoned.

[30] Foreign Application Priority Data

Dec. 31, 1981 [AU] Australia ..... PF 2125/81

[51] Int. Cl.[4] ..... F02B 3/00; I04F 1/06

[52] U.S. Cl. ..... 123/478; 123/531; 123/532; 123/533; 123/481

[58] Field of Search ..... 123/478, 531, 532, 533, 123/481, 482, 198 F, 458

[56] References Cited

U.S. PATENT DOCUMENTS

| | | | |
|---|---|---|---|
| 1,288,439 | 12/1918 | Pattinson | 123/533 |
| 1,721,032 | 7/1929 | Nordberg | 123/533 |
| 2,706,976 | 4/1955 | Gianini | 123/533 |
| 3,319,613 | 5/1967 | Begley et al. | 123/482 |
| 4,046,395 | 8/1977 | Demetrescu | 123/198 F |
| 4,103,055 | 8/1978 | Coles | 123/481 |
| 4,224,915 | 9/1980 | Emmenthal et al. | 123/533 |
| 4,489,695 | 12/1984 | Kohama et al. | 123/481 |
| 4,543,939 | 10/1985 | Ehrhart et al. | 123/533 |
| 4,556,037 | 12/1985 | Wisdom | 123/533 |
| 4,628,888 | 12/1986 | Duret | 123/533 |

*Primary Examiner*—Raymond A. Nelli

*Attorney, Agent, or Firm*—Murray and Whisenhunt

[57] ABSTRACT

A fuel injection apparatus for an internal combustion engine comprising a metering device to adjust the quantity of fuel delivered each cycle of the device in response to conditions in the engine induction passage, a control activating said device to effect a base number of fuel delivery cycles to the engine, and a sensor responsive to transient engine conditions to increase the number of cycles of the metering device above the base number per engine revolution.

33 Claims, 4 Drawing Sheets

CONTROL OF FUEL INJECTION APPARATUS FOR INTERNAL COMBUSTION ENGINES

This application is a continuation, of Ser. No. 894,459, filed Aug. 5, 1986, now abandoned. Which was a continuation of Ser. No. 751,455 filed July 2, 1985, now abandoned; which was a continuation of Ser. No. 626,718 filed July 2, 1984, now abandoned, which was a continuation-in-part of Ser. No. 454,656 filed Dec. 30, 1982, now abandoned.

This invention relates to the control of fuel injection apparatus used to supply fuel to an internal combustion engine. There is currently in use a variety of systems for controlling the quantity of fuel injected to an internal combustion engine in accordance with the speed and load demands of the engine.

The presently-known systems may be loosely categorised into mechanical and electronic systems, the distinction being that whereas mechanical systems generally meter fuel by a combination of dynamic responses to mechanical and physical effects, electronic systems generally allow sensed information to be processed in a sophisticated manner by electronic circuitry in order to arrive at the metered fuel quantity. Often, mechanical systems have the advantage of simplicity and relatively low costs in a given engine control application but may have disadvantages which include lack of response to sudden and short term variations in fuel demand. The fully electronic systems have the capability to respond quickly to a wide range of engine conditions, however, electronic systems may not be cost-effective in some applications, especially where improved control is of little practical benefit. In engines not subject to severe exhaust emission constraints the benefit of improved control may be outweighed by the increase in costs. Additionally electronic systems require high skill in regard to maintenance and repair.

There has been proposed in various prior published patent specifications to provide a fuel injection system wherein the quantity of fuel admitted each cycle is controlled by the period that an electronically operated nozzle valve is open to permit injection of the fuel. This basic type of system is referred to in British Patent Nos. 1,107,989; 1,149,073 and U.S. Pat. No. 3,626,910.

All of these systems rely upon the use of an injector nozzle having an electro-magnetically operated valve and to which fuel is constantly supplied at a set pressure by a suitable fuel pump. Appropriate electronic controls determine the fuel demand of the engine in accordance with selected engine operating parameters and hence deliver a signal to the electro-magnetically controlled valve so that the valve is held open for a period depending upon the fuel demand of the engine. As the fuel supply to the valve is at a constant pressure the quantity of fuel delivered is directly proportional to the duration of the opening of the valve. A suitable triggering mechanism is provided which operates in accordance with the speed of the engine to time the opening of the electronically controlled valve relative to the engine cycle so that the fuel is delivered at the correct point in the engine cycle.

In British Patent No. 1,149,073 it is proposed to subdivide each injection period into a number of elementary injections so as to obtain better mixing of the fuel with the air and hence more complete combustion. In this proposal, each and every injection is sub-divided into a number of elementary injections, irrespective of the load conditions on the engine, and variations in load conditions and other controlling factors are taken into account by varying the number and duration of each elementary injection so that for each injection the total required amount of fuel is injected.

This system does not incorporate provision for the specific introduction of additional fuel under specified conditions, such as acceleration, but merely relies on the overall control system to respond to the changed engine conditions by an appropriate increase in the total duration of each injection period.

The principal of sub-dividing each injection period into a number of elementary injections is also employed in the injection system proposed in U.S. Pat. No. 3,626,910 and again it is adopted for the purposes of obtaining improved fuel mixing and combustion. However, in this proposal the sub-dividing of each injection into a number of elementary injections occurs during the lower speed range of the engine, and as the engine speed increases, the number of elementary injections decreases, until at high speed operation a single continuous injection takes place to supply the total amount of fuel required.

Again, as in the proposal of British Patent No. 1,149,073, no specific provision is made for supplying additional injections of fuel during severe load conditions, such as acceleration, and the basic control system is relied upon to increase the total time of injection on each cycle in accordance with the operating conditions of the engine.

British Patent Nos. 1,272,595; 1,305,612 and 1,319,671 each relate to proposals whereby the basic fuel injection system as disclosed in British Patent Nos. 1,107,989 and 1,149,073 are modified so that further pulses of electrical energy are provided to the electro-magnetically operated fuel injection valve, when the engine is required to accelerate, so as to increase the total period which the valve is open during each injection cycle and therefore increase the total amount of fuel delivered.

All of the injection systems disclosed in the various prior art specifications discussed herein require a comparatively expensive electronic processor to receive signals in accordance with the state of various engine operating parameters and to then analyse this information and produce a signal which will result in the electromagnetic nozzle valve being opened for the required duration to deliver the necessary fuel to meet the engine demand. Where provision is made to provide additional deliveries of fuel under selected load conditions, such as acceleration, there is required further electronic equipment to produce the necessary signals and the processor must be of a more complicated nature to be able to handle the additional input and produce the required additional output signals. This type of control system for fuel injection is acceptable in the more expensive motor vehicles and particularly. in motor vehicles which already incorporate processors for controlling electrical circuits and other functions of the vehicle. However, the costs involved in supplying such equipment is not acceptable in the low to medium price range of motor vehicles, even though it is desirable to adopt fuel injection systems in such vehicles in order to simplify the compliance with current pollution control regulations.

It is the object of the present invention to provide a fuel injection apparatus which may be controlled by comparatively simple mechanisms and has improved response characteristics compared with some current systems.

With the above stated object in view there is provided a fuel injection apparatus for an internal combustion engine having one or more combustion chambers comprising an injector nozzle for each combustion chamber, the nozzle having a fixed size constantly open orifice, means to deliver metered quantities of fuel to the nozzle for admission to the combustion chamber, means to adjust said metered quantity in response to a selected condition in the engine air induction system, means to activate said delivery means in response to the engine speed, said activating means being adapted to effect a base number of deliveries of the metered quantity of fuel for each combustion chamber per engine cycle, and means to increase the number of deliveries of the metered quantity of fuel per cycle for at least one combustion chamber in response to another selected engine condition.

The means to adjust the metered quantity of fuel is preferably operable in response to the pressure and/or the velocity of the air in the induction passage of the engine. These means may be a mechanical mechanism including a fluid motor responsive to the pressure and/or speed or mass flow of the air in the induction passage. The motor drives a member, the movement of which varies the metered quantity of fuel delivered to the nozzle. The motor may comprise a piston or diaphragm mounted in a chamber and urged by resilient means to move in one direction, with the air induction pressure applied to the piston or diaphragm to induce movement in the opposite direction as said pressure decreases.

Conveniently there is provided a fuel injection apparatus for an internal combustion engine having one or more combustion chambers comprising an injector nozzle for each combustion chamber, the nozzle having a fixed size constantly open orifice, means to deliver metered quantities of fuel to the nozzle for admission to the combustion chamber, mechanical means to adjust said metered quantity in response to a selected condition in the engine air induction system, electrically operable means to activate said delivery means in response to the engine speed, said activating means being adapted to effect a base number of deliveries of metered quantities of fuel to each combustion chamber per engine cycle, and means responsive to at least one selected engine operating condition to increase the number of deliveries per cycle of metered quantities of fuel to at least one combustion chamber.

The means to activate the delivery means may be controlled by electrical pulses generated proportional to engine speed. The number of pulses generated per revolution is preferably a multiple of the base number of deliveries per revolution. Under steady load conditions a proportion of the pulses generated are depressed, so the number of pulses applied to the delivery activating means is equal to the base number of deliveries. Upon the selected engine fuel demand arising the proportion of pulses applied to the delivery activating means per engine cycle is increased to thereby increase the number of fuel deliveries per engine cycle.

The delivery means is preferably solenoid operated and arranged to be activated to deliver a metered quantity of fuel once for each cycle of the solenoid. The solenoid may be cycled once for each pulse received, or proportional to the number of pulses received.

It will be understood that the present proposal is to adjust the metered quantity of fuel in order to accommodate normal load variations which are of gradual nature and so do not require rapid and large variations in the metered quantity of fuel. When rapid and/or substantial load variations occur these are accommodated by varying the number of deliveries of the metered quantity of fuel as this variation can be effected more rapidly than a large variation in the actual metered quantity of fuel. However, when rapid and/or substantial load variations occurs there will of course be initiated an adjustment to the metered quantity of fuel as that load variation will be reflected in the conditions in the air induction passage of the engine. This adjustment is comparatively slow and so the additional fuel required to meet this load variation will be derived from the additional deliveries of the metered quantity of fuel. The additional deliveries will cease as the adjustment to the metered quantity of fuel becomes effective to meet the new engine load. It is therefore seen that the additional deliveries of fuel provide the rapid response to the variation in load, while the adjustment to the metered quantity of fuel is in progress to meet the new load conditions.

Sudden decreases in load and hence fuel demand may also occur, and in such instances there may be a delay in the necessary correction to the metered quantity of fuel. In this situation the means to activate delivery of the metered quantities of fuel may be arranged to decrease the number of deliveries per engine cycle.

The means for delivering the predetermined quantity of fuel may be the metering and injection apparatus as disclosed in U.S. Pat. No. 4,462,760 which is hereby incorporated by reference, and a solenoid operated valve may be used in conjunction therewith to activate the delivery of the metered quantity of fuel.

The engine demands which may call for an increase in the number of deliveries of metered quantity of fuel per engine cycle, include such demands as acceleration of the engine, particularly when accelerating from idling speed, low engine temperature, and engine mode of operation, such as cranking at starting. The existence of these demands may be sensed by a variety of currently known sensing devices, such as potentiometers, which vary the voltage or the rate of change of voltage applied to an electronic processors, temperature sensors, and the voltage condition of starting circuits, for example.

In regard to the sensing of a demand for additional fuel during acceleration, a potentiometer can be coupled to the driver operated accelerator, so that if the rate of movement of the accelerator exceeds a predetermined value the processor will increase the number of pulses fed to the solenoid, and hence the number of solenoid cycles per engine cycle will increase and the fuel supply to the engine will correspondingly increase. The processor may be arranged so that there is an increase in the fuel supply over only one cycle of the engine, or over a number of cycles, which number may vary in accordance with the rate of acceleration demanded by the accelerator. The additional deliveries of fuel may continue over a number of engine cycles at a constant or varying rate.

The invention will be more readily understood from the following description of one practical arrangement of the fuel control system in accordance with the present invention, as illustrated in the accompanying drawings.

In the drawings

Figure 1:
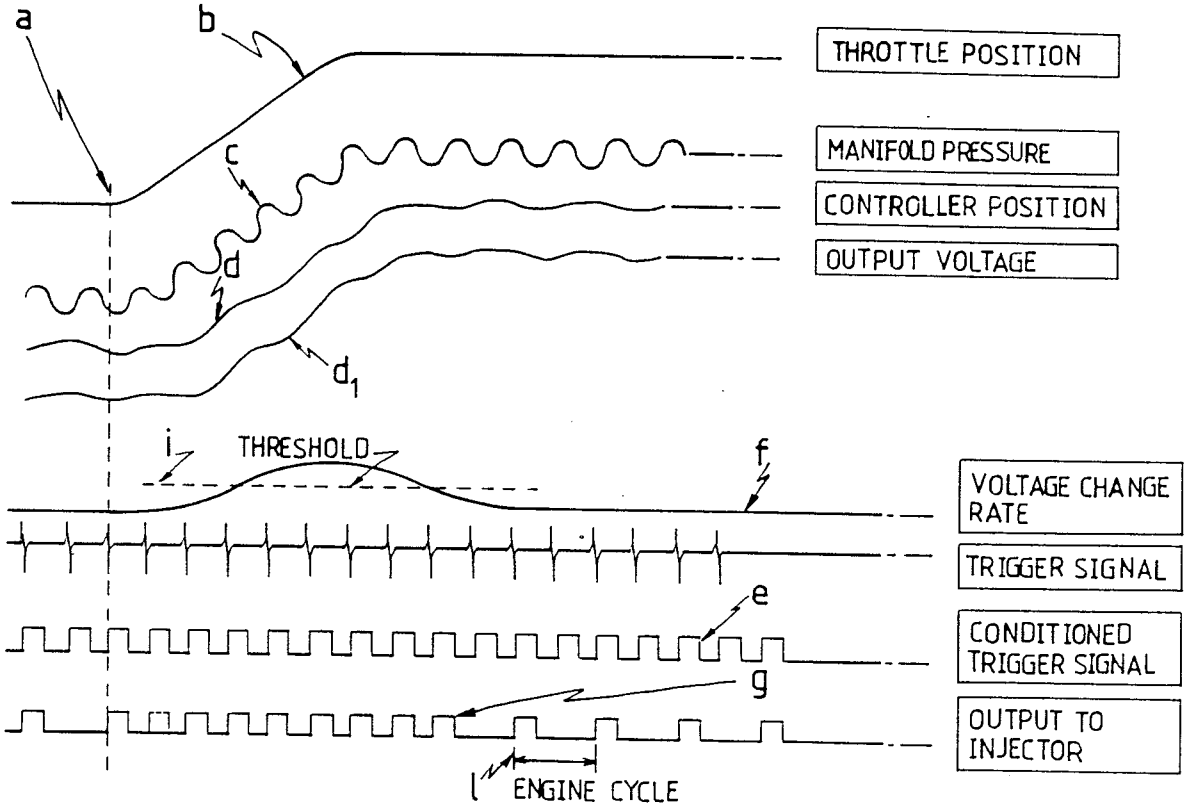
FIG. 1 is a diagrammatic representation of operation of the invention.

Referring now to FIG. 1 of the drawings, there is illustrated therein diagrammatically the manner in which the load conditions of the engine are monitored, and when a rapid change in load conditions is detected, how this is applied to produce the additional delivery or deliveries of measured quantities of fuel. The diagram illustrates the engine running at idling speed and then accelerating to a higher steady speed.

The vertical broken line (a) indicates the point of initiation of movement of the throttle from the idle position towards the higher steady speed condition. As the throttle moves through the transition positions indicated by the inclined line (b) there will be a corresponding steady average increase in the absolute pressure in the air induction manifold of the engine as indicated at (c). The actual pressure varying during this transition period in accordance with the cycling of the combustion chamber to which the manifold is connected.

The means controlling the metered quantity of fuel delivered to the engine is responsive to the pressure in the inlet manifold of the engine, and accordingly, during the transition period the metered quantity of fuel available for admission to the engine will increase as indicated by line (c) in FIG. 1.

A potentiometer is incorporated in the mechanism which adjusts the metered quantity of fuel so that the output voltage from the potentiometer is related to the metered quantity of fuel. Thus the output voltage of the potentiometer will vary in the same manner as the metered quantity of fuel varies and is represented by the line (d) in FIG. 1. The output voltage from the potentiometer is fed to a processor and the rate of change of this voltage determined at fixed reference points in the engine cycle.

The engine is provided with a trigger signal generator arranged to deliver two trigger signals each cycle of the engine which in a four-stroke engine is one trigger signal per revolution of the engine. The trigger signals are used to produce a pulsating voltage (e) that may be applied to a suitable electrically controlled device, such as a solenoid, to time the deliveries of fuel in relation to the rotation of the engine. Thus without further processing of the trigger signals the solenoid would be activated twice each engine cycle. The trigger signals and the resulting voltage are also used to time the point of delivery of the metered quantity of fuel within the engine cycle.

The processor is arranged so that under normal steady load conditions of the engine, only each alternate voltage pulse is applied to the solenoid or other electrical device regulating the delivery of the metered quantity of fuel. Thus under these steady load conditions there is only one metered quantity of fuel delivered to the engine during each engine cycle. The processor determines whether steady load conditions exist by comparing against a reference value the rate of change of the output voltage from the potentiometer since the output voltage varies with variations in the induction manifold pressure as illustrated by line ($d_1$). If the rate of change of the voltage is above a predetermined value, then the alternate voltage pulses are not suppressed and are permitted to be applied to the solenoid or other electrical control regulating the delivery of fuel to the engine. As a result two metered quantities of fuel are delivered each cycle of the engine as compared with the single measured quantity delivered under steady load conditions.

The line (g) in FIG. 1 indicates the actual control voltage pulses applied to the solenoid controlling the delivery of the metered quantities of fuel under the load conditions represented in FIG. 1 during transition from idling to a higher steady speed. Line (f) in FIG. 1 indicates the rate of change of the output voltage from the potentiometer which varies with manifold pressure. The predetermined threshhold of the rate of change is indicated by the horizontal broken line (i).

In the above discussed mode of operation of the regulation of the delivery of additional metered quantities of fuel, a switch may be provided in the potentiometer circuit that is actuated by the throttle so that when the throttle is in the idled position the switch is open. Thus the processor will not be able to receive information regarding the potentiometer output voltage each half cycle, and thus there will be a steady state wherein there will only be one delivery of the metered quantity of fuel to the engine per engine cycle.

This switch also enables the processor to be programmed to block all voltage pulses to the solenoid when the engine is decelerating after the throttle has been moved to the idle position. It will be appreciated that when the throttle is closed suddenly whilst the engine is running at a significant speed, there is a time delay in the engine falling to idle speed, as a result of the inertia of the components of the engine. It is clear that no fuel is required to be delivered to the engine during this deceleration period, and thus the processor can be programmed so that when the throttle actuated switch is closed, and the engine speed is above a predetermined figure, which is conveniently slightly above idle speed, all voltage pulses will be suppressed and so there will be no deliveries of metered quantities of fuel to the engine. Once the engine speed has dropped below the predetermined minimum figure, the processor will again permit the voltage pulses to be applied to the solenoid at the rate of one pulse per engine cycle so that there will be re-established one delivery of a metered quantity of fuel per engine cycle. The speed of the engine can be determined by the rate of the trigger signals received by the processor as is the situation conventional electronic revolution counters.

Figure 2:
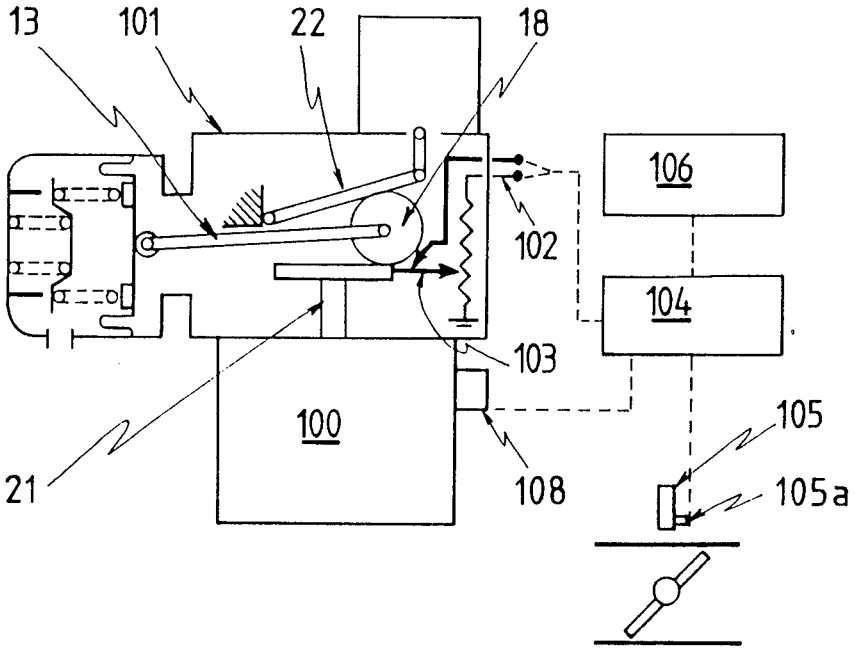
FIG. 2 is a diagrammatic layout of the control apparatus and associated equipment.

Referring now to FIG. 2 of the drawings, there is shown in block diagram form the components of the fuel control system of the present invention, particularly as described above in connection with FIG. 1. In this drawing the metering unit 100 has an induction manifold pressure operated mechanical mechanism 101 to regulate the quantity of each metered delivery of fuel to the engine. The various components of the mechanical mechanism shown diagrammatically in FIG. 2 have the same reference numeral as the corresponding component has as shown in more detail in FIG. 3. The potentiometer 102 has a movable wiper 103 mounted on the metering member 21 to co-operate with the resistance strip 107, and the variable voltage from the potentiometer is applied to the processor 104. The throttle actuated switch 105 is also coupled to the processor 104 so as to control the application of voltage to the potentiometer 102 as previously described. The speed sensor, included in the sensor unit 106, is activated by a rotating portion of the engine, such as its crankshaft, or flywheel to give trigger signals to the processor in accordance with the engine speed. The voltage pulses eminating from the processor are applied to the solenoid valve 108 to regulate the frequency of the deliveries of metered quantities of fuel to the engine. In addition to the speed sensor the sensor unit 106 may include a number of devices to sense various engine conditions that influence the fuel demand of the engine including ambient and engine temperature sensors, and an air charge temperature sensor.

The throttle actuated switch 105 may be of a conventional type which is normally in a closed circuit condition and having an actuator member 105*a* which when depressed opens the circuit through the switch. The switch is located so the throttle, when in the engine idle position, depresses the activator member 105*a* to open the switch. A suitable commercial switch for this purpose is that available from Ford Motor Co. Australia Pty. Ltd. under Part No. XE 9P 755A, this switch being marketed under the trade mark BOSCH.

The potentiometer 102 may be any suitable commercial linear potentiometer such as that marketed by Waters Manufacturing Inc. of Wayland, Mass., such as the company's potentiometer Part No. MEL 3025.

Figure 3:
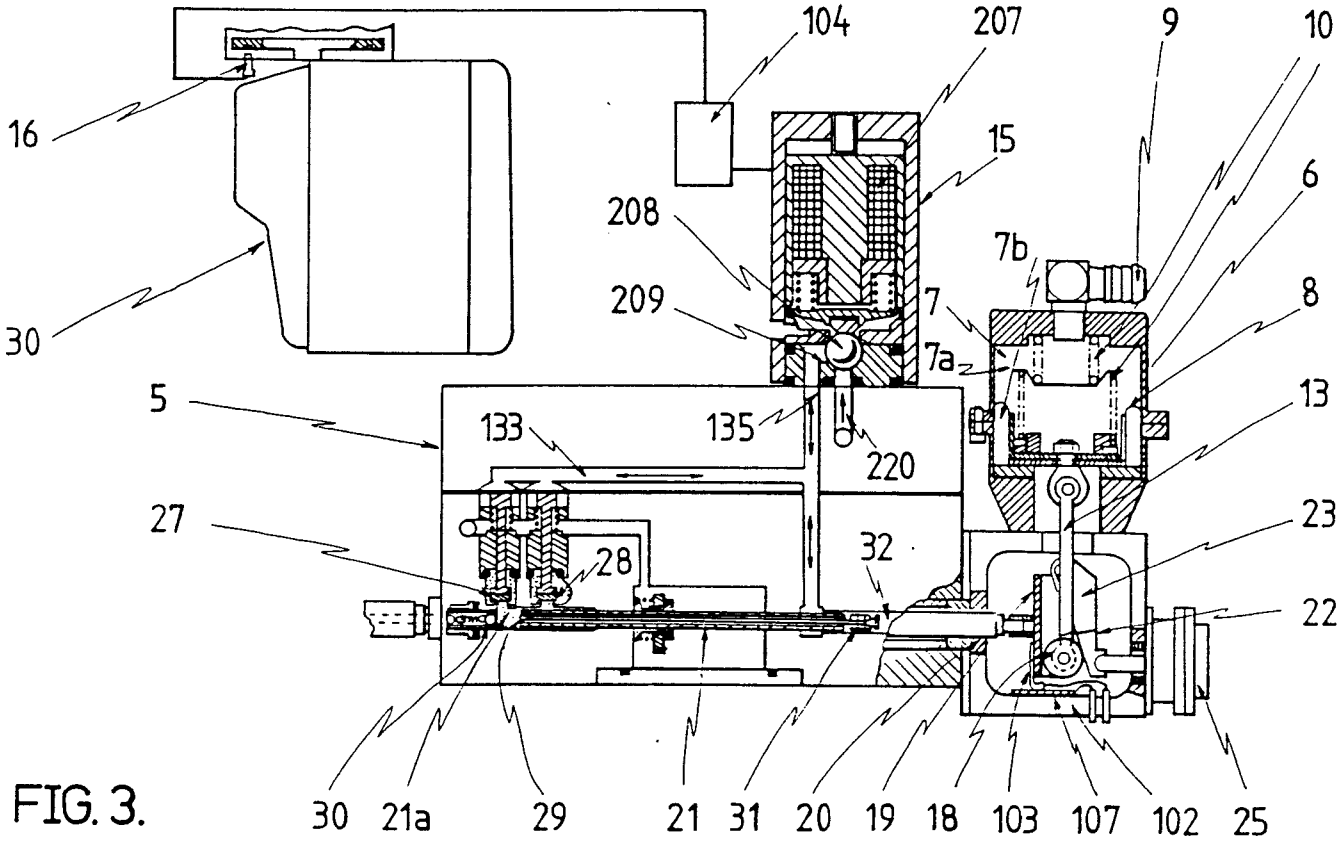
FIG. 3 is a side view partly in section of one embodiment of the apparatus according to the present invention.

Referring now to FIG. 3 of the accompanying drawing there is illustrated a fuel metering and injection device operating on the principle of the invention disclosed in the previously referred to U.S. Pat. No. 4,462,760, and indicated generally at 5, coupled to a mechanical control device 6 to affect adjustment of the quantity of fuel metered during each cycle of the injector. The solenoid operated air valve 15 controls the supply of air to the fuel and delivery valves of the fuel metering and injection device 5.

The mechanical control device 6 corresponding to the mechanical mechanism 101 of FIG. 2 comprises a chamber section 7 divided into two sections by a diaphragm 8 with the chamber section 7*a* on one side of the diaphragm connectable via the coupling 9 to the air induction manifold of an engine. The below-atmospheric pressure in the manifold is thus applied to the chamber section 7*a* on one side of the diaphragm whilst atmospheric pressure exists in the chamber section 7*b* on the other side of the diaphragm. The springs 10 are located within the chamber section 7*a* to act upon the diaphragm to oppose the movement induced thereinto by the application of below-atmospheric pressure in the chamber section 7*a*. Accordingly, by an appropriate selection of the rate of springs 10, the movement of the diaphragm is proportional to the pressure existing in the induction manifold of the engine.

Portion of the diaphragm 8 is coupled with the rod 13 carrying separate co-axial rollers 18 at its free end. One of the rollers 18 engages the plate 19 which is attached to the rod 20 that actuates metering member 21 extending into the metering chamber 21*a* of the device 5 and the volume of fuel delivered each cycle is varied by the extent that the member 21 extends into the metering chamber. The other of the rollers 18 engage the inclined face 22 of the ramp 23 which during normal operation has a fixed position.

Accordingly, it will be seen that as the pressure in the induction manifold decreases the rollers 18 will move upwardly as viewed in the drawing along the inclined face 22 of the ramp causing the rod 20 to move inwardly of the metering device and reduce the quantity of fuel metered during each cycle. As is known the pressure in the induction manifold of an engine decreases as the demand for fuel decreases, and accordingly, the roller 18 moves along the inclined face 22 in the direction to reduce the quantity of metered fuel per cycle as the pressure in the induction manifold decreases.

The wiper 103 of the potentiometer 102 is mounted on the plate 19, which is connected through rod 20 to the metering member 21. The wiper 103 is thus moved along the resistance strip 107 of the potentiometer in response to the change in pressure in the induction manifold of the engine. The change of the output voltage of the pontentiometer 102 is thus directly related to the change of the engine fuel demand as previously discussed with reference to FIG. 1. The output from the potentiometer is fed to the processor 104 which determines the rate of change of the output voltage of the potentiometer and if this rate is beyond a predetermined value, an additional metered quantity of fuel will be delivered as described with reference to FIG. 1.

In the embodiment shown in the inclination of the inclined face 22 of the ramp 23 may be adjusted by the actuator 25 so that the rate of change of fuel quantity per unit of movement of the diaphragm 8 can be varied to suit particular engine operating conditions. The extent of control applied to actuator 25 depends on the selected level of sophistication of control. The simplest arrangement is a mechanical actuator which is adjusted manually during cold start and warm up. The most sophisticated are programmed control strategies which make corrections for variables such as engine speed, engine temperature, barometric pressure and ambient temperature. However, a temperature-sensitive element communicating engine temperature is commonly used as the most cost effect compromise in many applications.

The solenoid operated valve 15 controls the supply of air to the pneumatically operated fuel inlet and outlet valves 27 and 28, and the supply of air through the valve 29 to the metering chamber 21*a* of the metering and injection device 5. The sequence and manner of operation of these valves is disclosed in more detail in the U.S. Pat. No. 4,462,760 hereinbefore referred to.

The quantity of fuel displaceable from the chamber 21*a* by the air is the fuel located in that portion of the chamber 21*a* located between the point of entry of the air to the chamber, and the point of discharge of the fuel from the chamber, this is the quantity of fuel between the air admisssion valve 29 and the delivery valve 30.

The air admission valve 29 at the end of the metering rod 21 located in the metering chamber 21*a* is normally held closed by the spring 31 to prevent the flow of air from the air supply chamber 32 to the metering chamber 21*a*. Upon the pressure in the chamber 32 rising to a predetermined value the valve 29 is opened to admit the air to the metering chamber 21*a*, and thus displace the fuel therefrom.

The pulse generator 16 may be any known type such as an optic switch including an infra-red source and a photodetector with Schmitt trigger, and is mounted on the engine 30 at a suitable location to generate pulses proportional to the speed of rotation of the engine. The pulses are then fed to an appropriate processor 104 programmed so that only the base number of pulses are fed to the solenoid valve 15 for each cycle of the engine at steady operating conditions. Accordingly when the rate of change of the output voltage of the potentiometer 102 indicates that the fuel demand is such that it is required to increase the number of fuel deliveries per cycle of the engine the processor can, in accordance with its program, increase the number of pulses fed to the solenoid above the base number.

One basic form of the processor circuit to control the timing of the base number of fuel deliveries, and to determine when one or more additional deliveries of fuel above the base number of delivery are required, and to translate these determinations into activation of the metering mechanism, will now be described with reference to FIG. 4. This processor circuit is intended to be used in conjunction with the metering mechanism previously described with reference to FIGS. 2 and 3.

Figure 4:
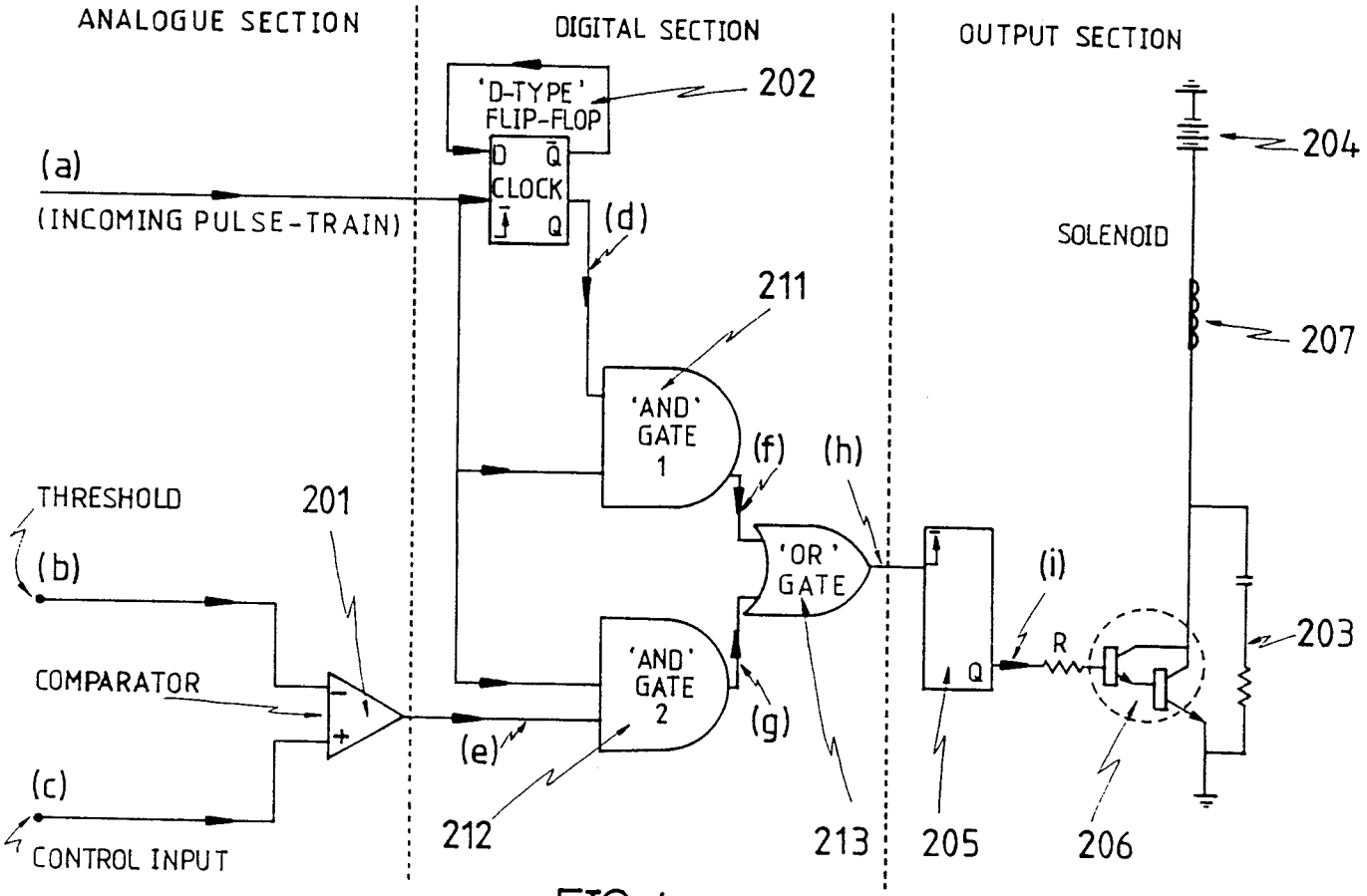
FIG. 4 is a diagram of the basic circuit of the processor to control the fuel metering device.

The circuit may be considered to consist of three sections, and is so divided in FIG. 4, namely (1) Analogue Section
(2) Digital Section
(3) Output Section The analogue section comprises a comparator 201 which receives signals 'b' and 'c'. Signal 'b' is a reference or threshold signal against which signal 'c' will be compared. Signal 'b' is based on one or a number of measured values of engine operating conditions which represent that the base number of deliveries is adequate to meet the fuel demand of the engine.

The signal 'c' is derived from the rate of change of a particular engine condition, such as the rate of change of the engine manifold pressure as detected by the potentiometer 102 in FIG. 2.

The comparator 201 provides an output signal 'e' which is 'high' if signal 'c' exceeds signal 'b' indicating the engine conditions require the additional metered quantity of fuel. If the signal 'c' does not exceed signal 'b', the output signal 'e' is 'low', indicating only the base number of fuel deliveries is required.

The digital section receives an incoming pulsed signal 'a' having a frequency directly related to the engine speed, and phased in relation to the engine cycle. The signal 'a' may be derived from an inductive, magnetic, optical or similar position sensing device, as indicated at 16 in FIG. 3, that will provide a signal pulsed at a frequency equal to engine speed. Thus the signal 'a' is pulsing at twice the frequency of the engine cycle for a four-stroke engine.

The signal 'a' is fed to an edge triggered 'D'-type flip flop divider 202 which is connected in a typical configuration to divide the frequency of the incoming signal by two. Thus Q output is connected to the 'D' input to be clocked by the clocking edge of signal 'a' applied to the clock input, whereby the signal 'd' produced at the output Q, is pulsed at half the frequency of signal 'a'.

The signal 'a' and the signal 'd' are applied to the 'AND' gate 211 which "ands" the signals to provide output signal 'f'. The signal 'f' is a pulsed command signal of a frequency half that of signal 'a' corresponding to the base number of deliveries of fuel of one per engine cycle or one each two revolutions of the engine.

The 'AND' gate 212 receives and 'ands' signal 'a' and signal 'e' to produce output signal 'g'. In the event that no signal 'e' is received by 'AND' gate 212 from the comparator 201 no pulsed signal 'g' passes gate 212. If signal 'e' is received by 'AND' gate 212, signal 'g' is pulsed at engine speed frequency, that is twice the frequency of the base number of deliveries of fuel or two per engine cycle.

Signal 'f' and signal 'g' are both fed to 'OR' gate 213 to provide the final output pulse signal 'h' to the output section of the circuit. The 'AND' gate 211 will always supply pulsed signal 'f' to 'OR' gate 213 and 'AND' gate 212 will only supply pulsed signal 'g' when signal 'e' exists as previously described. Thus when only signal 'f' is received by 'OR' gate 213 the output signal 'h' will be pulsed at a frequency corresponding to the base number of deliveries of fuel which corresponding to one each cycle of the engine. When both signals 'f' and 'g' are received by 'OR' gate 213, the output signal 'h' will pulse at a frequency corresponding to twice the base number of deliveries of fuel which corresponds to two each cycle of the engine.

The monostable multi vibrator 205 is triggered by the trigger edge of the output signal 'h' applied to the trigger input thereof. This triggering results in a pulsed signal 'i' at output 'Q' of the monostable. As the pulse width of signal 'h' is determined by engine speed, the monostable multi vibrator is provided so the output signal 'i' does not similarly vary in pulse width. In the simple form the monostable multi vibrator will give a fixed pulse width of the order of 8 to 12 ms.

The signal 'i' is applied to the base of output power drive transistor (Darlington type) 206, via the resistor 'R'. The transistor 206 is interposed between one end of the coil 207 of solenoid valve 15 (FIG. 3), and ground to provide a connection therebetween when the signal 'i' is applied thereto. The other end of the coil 207 is connected to a power source such as battery 204.

The solenoid coil is thus energised for a period equal to the pulse width of signal 'i' and at a frequency equal to that of pulsed signal 'i'. The R.C. circuit 203 is provided to protect the drive transistor 206 from voltage surges.

Referring to FIG. 3, while the coil 207 of solenoid valve 15 is energised, the valve element 208 is moved off the seat 209 so that air under pressure in the air supply conduit 220 may pass to conduits 133 and 135 to effect delivery of a metered quantity of fuel to the engine. Upon de-energising of the coil 207, the valve element 208 is returned to seat 209 and the air supply terminated. The metering chamber may then be filled with fuel in preparation for the next delivery of fuel at the next pulse of signal 'i'.

In the description with reference to FIG. 1 and FIG. 2 throttle switch 105 is provided to terminate delivery of fuel when the throttle is returned to the idle position. This switch may be arranged to interrupt signal 'i' to the drive transistor 206.

The preceding description with respect to FIG. 4 is based on the control of the metering of fuel to a single cylinder engine or to one cylinder of a multi-cylinder engine, each operating on a four stroke cycle. In a multi-cylinder engine having an independent fuel metering device with respective solenoid valves for each cylinder the pulse frequency of signal 'a' should be multiplied by the number of fuel deliveries required per revolution of the engine. Also the output signal 'i' will be suitably distributed in sequency to the solenoids of the respective metering devices according to the firing order of the engine, so that each solenoid will normally effect one fuel delivery to each cylinder for each cycle.

Thus in one example a four-stroke four cylinder engine may be equipped with a fuel injector having four fuel metering units, one for each cylinder, each controlled by an individual solenoid valve. The device 16 generating signal 'a' is then arranged to produce four pulses per revolution of the engine, and the frequency divider 202 will still divide the number of pulses by two. There is thus two pulses per revolution available for activation of the four solenoid valves. As the engine is a four-stroke cycle each cylinder requires fuel only once each two revolutions.

Accordingly with two pulses per revolution, the output signal 'i' may be applied once to each solenoid valve once every two revolutions of the engine and, so the base number of deliveries of fuel to each cylinder engine is made once every two revolutions or once each cycle. Also when engine conditions require the signal 'i' will pulse four times per two revolutions so that an additional delivery per cycle is made to each cylinder.

It is also possible to arrange to provide the increase in the number of deliveries of fuel to only one or some of the four cylinders, such as when the increase in demand on the engine is relatively small. This may also apply where the metering system response rapidly to increase the metered quantity of fuel per solenoid cycle.

In the preceding example an individual solenoid valve is provided to control each metering unit however where the fuel is delivered into the induction passage as distinct from directly into each cylinder, the timing of the delivery relative to the cylinder cycle is not critical. Thus fuel for a number of cylinders may be delivered at the same time, into the induction passage. In such a system individual solenoid valves for each metering chamber are not required. Acceptable performence has been obtained using only two solenoid valve each controlling two metering chambers, so a metered quantity of fuel is delivered for two cylinders each cycle of the solenoid valve. It is possible to use only one solenoid valve to control four metering chambers with a metered quantity of fuel being delievered for all four cylinders each solenoid valve cycle. However, the response to transient engine conditions is reduced as variations in the fuel supply are effected at relatively longer time intervals.

In the preceding description reference has been made to cylinders of engines which infers that the engine is a reciprocating piston engine, however, it is to be understood that the present invention is applicable to all types of internal combustion engines.

I claim:

1. In a fuel injection apparatus for an internal combustion engine having one or more combustion chambers, said apparatus comprising a respective fuel supply nozzle for each combustion chamber, metering means for preparing a metered individual discrete unit of fuel for delivery to each combustion chamber per cycle thereof, adjustment means to adjust the fuel quantity of each discrete unit of fuel in relation to the engine load, delivery means for delivering each metered discrete unit of fuel through a nozzle for the respective combustion chamber, and activation means for activating the delivery means to deliver a metered individual discrete unit of fuel through each nozzle per combustion chamber cycle during normal engine load conditions, the improvement comprising the activation means including electronic control means responsive to a selected engine load change for activating multiple deliveries of said discrete unit of fuel through at least one nozzle for a combustion chamber during at least one cycle thereof upon occurrence of said selected engine load change.

2. A fuel injection apparatus as claimed in claim 1 wherein the delivery means is adapted to apply a pulse of a gas to each discrete unit of fuel at a pressure to convey the unit of fuel individually to and through the respective nozzle.

3. A fuel injection apparatus as claimed in claims 1 or 2 wherein the activation means includes means to generate electrical pulses at a frequency proportional to the engine speed, and to activate the delivery means to effect delivery of the discrete units of fuel in proportion to the frequency of said electrical pulses.

4. A fuel injection apparatus as claimed in claims 1 or 2 wherein the activation means is adapted to activate the delivery means of a frequency of once per combustion chamber cycle during normal engine load conditions and twice per combustion chamber cycle during said selected engine load change.

5. A fuel injection apparatus as claimed in claims 1 or 2 wherein said adjustment means is operable in response to the pressure and/or speed or mass flow of the air in an air induction system supplying air to the engine.

6. A fuel injection apparatus as claimed in claims 1 or 2 wherein said electronic control means is responsive to an acceleration load on the engine.

7. A fuel injection apparatus as claimed in claims 1 or 2 wherein said electronic control means is reponsive to the engine temperature.

8. A fuel injection apparatus as claimed in claims 1 or 2 wherein the delivery means is solenoid operated and said metered discrete unit of fuel is delivered once each cycle of the solenoid.

9. A fuel injection apparatus as claimed in claims 1 or 2 wherein the metering means includes a metering chamber having a selectively openable discharge port, means operable to supply fuel to the chamber to fill the metering chamber with fuel, and the delivery means is operable to selectively admit gas to the metering chamber to displace fuel from the metering chamber upon opening of the discharge port.

10. A fuel injection apparatus as claimed in claim 9 wherein the adjustment means includes means to control the quantity or fuel displaceable from the metering chamber by the admission of the gas to the metering chamber.

11. A fuel injection apparatus as claimed in claim 10 wherein the means to control the quantity of fuel displaceable from the metering chamber includes means to adjust the volume of the metering chamber between the position of entry of the gas to and the position of discharge of fuel from the metering chamber, to thereby control the quantity of fuel displaceable from the metering chamber by the gas.

12. In a fuel injection apparatus for an internal combustion engine having one or more combustion chambers, said apparatus comprising a respective fuel supply nozzle for each combustion chamber, metering means for preparing a single metered discrete unit of fuel for delivery to each combustion chamber each cycle thereof, adjustment means to adjust the fuel quantity of each discrete unit of fuel in relation to the engine load so that each discrete unit of fuel meets the fuel requirement of each combustion chamber during normal engine load conditions, delivery means for delivering each single metered discrete unit of fuel through a nozzle for the respective combustion chamber, and activation means for activating the delivery means to deliver said single metered individual discrete unit of fuel through each nozzle each combustion chamber cycle during normal engine load conditions, the improvement comprising the activation means including electronic control means responsive to an increasing transient in engine load to effect an additional delivery of said metered discrete unit of fuel in at least one cycle of at least one combustion chamber upon occurrence of said increasing transient in engine load.

13. A fuel injection apparatus as claimed in claim 12, wherein the delivery means is adapted to apply a pulse of a gas to each single metered discrete unit of fuel at a pressure to convey the unit of fuel individually to and through the respective nozzle.

14. A fuel injection apparatus as claimed in claims 12 or 13 wherein the activation means is adapted to activate the delivery means at a frequency of once per combustion chamber cycle during normal engine load conditions and twice per combustion chamber cycle during said increasing transient in engine load.

15. A fuel injection apparatus as claimed in claims 12 or 13, wherein said adjustment means is operable in response to the pressure and/or speed or mass flow of the air in an air induction system supplying air to the engine.

16. A fuel injection apparatus as claimed in claims 12 or 13, wherein said electronic control means is also responsive to the engine temperature to effect an additional delivery of said metered discrete unit of fuel.

17. A fuel injection apparatus as claimed in claims 12 and 13 wherein the delivery means is solenoid operated and said metered discrete unit of fuel is delivered once each cycle of the solenoid.

18. A fuel injection apparatus as claimed in claims 12 or 13, wherein the metering means includes a metering chamber having a selectively openable discharge port, means operable to supply fuel to the chamber to fill the metering chamber with fuel, and the delivery means is operable to selectively admit gas to the metering chamber to displace the fuel from the metering chamber upon opening of the discharge port to thereby provide the metered discrete unit of fuel.

19. A fuel injection apparatus as claimed in claim 18, wherein the adjustment means includes means to control the quantity of fuel displaceable from the metering chamber by the admission of the gas to the metering chamber.

20. A fuel injection apparatus as claimed in claim 19, wherein the means to control the metered quantity of fuel displaceable from the metering chamber includes means to adjust the volume of the metering chamber between the position of entry of the gas to and the position of discharge of fuel from the metering chamber, to thereby control the quantity of fuel displaceable from the metering chamber by the gas.

21. A fuel injection apparatus as claimed in claim 20, wherein said means to adjust the chamber volume includes a member extending into the metering chamber and movable relative to the metering chamber in the direction of displacement of the fuel from the metering chamber to vary the volume of the metering chamber between the positions of entry of the gas to and of discharge of the fuel from the metering chamber to thereby vary the metered discrete unit.

22. A fuel injection apparatus according to claim 21, wherein the member extending into the metering chamber and movable relative to the metering chamber has the gas inlet port formed therein.

23. A fuel injection apparatus as claimed in claim 21, wherein the means to adjust the mtering chamber volume includes means to control the extent of projection of the movable member into the metering chamber.

24. A fuel injection apparatus as claimed in claim 23, wherein said means to control the extent of projection of the movable member is adapted to operate in response to the pressure in an air induction system supplying air to the engine.

25. A fuel injection apparatus as claimed in claim 24, wherein said means to control the extent of projection of the movable member includes a control chamber, a control member in said control chamber and movable relative thereto in one direction in response to the pressure in the control chamber on one side of the control member, said control chamber on said one side of the control member being connectable to the air induction system of the engine, resilient means urging the control member to move in the opposite direction to said one direction, and means operably connecting said control member to the movable member extending into the metering chamber so that as the pressure in the control chamber decreases the extent of projection of the member into the metering chamber increase whereby the metered discrete unit of fuel decreases in quantity.

26. A fuel injection apparatus as claimed in claim 25, wherein the member extending into the metering chamber is operably connected to a first member having a first surface transverse to the direction of movement of the member relative to the metering chamber, and directed toward a relatively fixed second surface, said first and second surfaces defining a converging gap therebetween, a spacer member located in said gap in engagement with said first and second surfaces operably connected to the control member whereby movement of the spacer member along the gap in response to the pressure in the control chamber varies the extent of projection of the movable member into the metering chamber to vary in quantity the metered discrete unit of fuel.

27. A fuel injection apparatus as claimed in claim 26, wherein the included angle of the gap between the first and second surfaces is adjustable.

28. A fuel injection apparatus as claimed in claim 26, wherein the admission of the gas to the metering chamber is controlled by a solenoid operable to selectively open a gas inlet valve to admit gas to the metering chamber.

29. A fuel injection apparatus as claimed in claims 12 or I3, wherein each combustion chamber fuel supply nozzle has a constantly open fixed size orifice.

30. A fuel injection apparatus as claimed in claim 29, wherein the activation means is adapted to activate the delivery means at a frequency of once per combustion chamber cycle during normal engine load conditions and twice per combustion chamber cycle during said increasing transient engine load.

31. A fuel injection apparatus as claimed in claim 29, wherein said adjustment means is operable in response to the pressure and/or speed or mass flow of the air in an air induction system supplying air to the engine.

32. A fuel injection apparatus as claimed in claim 29, wherein said electronic control means is responsive to an acceleration load on the engine.

33. A fuel injection apparatus for internal combustion engine having at least one combustion chamber, said apparatus comprising an injector nozzle for each combustion chamber, metering means for metering discrete, individual units of fuel and for delivering one of said metered discrete individual units of fuel to said nozzle for admission to said combustion chamber, adjustment means for adjusting the amount of fuel in each metered discrete individual unit in response to the requirements of an engine load change, and activation means to activate said metering means to deliver the single unit of fuel to the combustion chamber in timed relation to the engine cycles, the improvement comprising said activation means including base activation means for effecting the single delivery of said metered, discrete, individual unit of fuel through said nozzle to the combustion chamber each combustion chamber cycle during normal steady load conditions of the engine, and load change-responsive electronic secondary activation means for effecting a second delivery of a metered, discrete, individual unit of fuel each combustion chamber cycle to the combustion chamber in response to an increasing transient engine load change.

* * * * *